US009536514B2

(12) United States Patent
Lewis

(10) Patent No.: US 9,536,514 B2
(45) Date of Patent: Jan. 3, 2017

(54) HUNTING NOISE MASKING SYSTEMS AND METHODS

(71) Applicant: SOUND BARRIER, LLC, Saginaw, MI (US)

(72) Inventor: Adam Lewis, Saginaw, MI (US)

(73) Assignee: Sound Barrier, LLC, Saginaw, MI (US)

( * ) Notice: Subject to any disclaimer, the term of this patent is extended or adjusted under 35 U.S.C. 154(b) by 133 days.

(21) Appl. No.: 14/269,929

(22) Filed: May 5, 2014

(65) Prior Publication Data

US 2014/0334634 A1 Nov. 13, 2014

Related U.S. Application Data

(60) Provisional application No. 61/821,343, filed on May 9, 2013, provisional application No. 61/842,088, filed on Jul. 2, 2013.

(51) Int. Cl.
*G10K 11/175* (2006.01)
*H04K 3/00* (2006.01)

(52) U.S. Cl.
CPC ..... *G10K 11/175* (2013.01); *H04K 3/42* (2013.01); *H04K 3/825* (2013.01); *H04K 3/41* (2013.01); *H04K 2203/12* (2013.01)

(58) Field of Classification Search
CPC ..... G01K 11/175; H04K 2203/12
USPC ..... 381/386–387, 61, 73.1
See application file for complete search history.

(56) References Cited

U.S. PATENT DOCUMENTS

| | | | | |
|---|---|---|---|---|
| 4,150,637 | A | 4/1979 | Penick | |
| 4,437,428 | A | 3/1984 | Hoffelner | |
| 4,903,630 | A | 2/1990 | Rezmer | |
| 4,998,091 | A | 3/1991 | Rezmer | |
| 5,057,795 | A | 10/1991 | Napier | |
| 5,140,640 | A | 8/1992 | Graupe et al. | |
| 5,214,411 | A | 5/1993 | Herbruck | |
| 5,278,537 | A | 1/1994 | Carlo et al. | |
| D344,319 | S | 2/1994 | Liu | |
| 6,897,781 | B2 | 5/2005 | Cooper et al. | |
| 6,983,103 | B1 * | 1/2006 | Parcher | A01M 31/004 222/146.5 |
| 7,299,798 | B2 | 11/2007 | Flanagan | |
| 8,064,610 | B2 | 11/2011 | Ward et al. | |

(Continued)

FOREIGN PATENT DOCUMENTS

| | | | |
|---|---|---|---|
| EP | 1057365 | A1 | 12/2000 |
| EP | 1329159 | A1 | 7/2003 |

(Continued)

*Primary Examiner* — Disler Paul
(74) *Attorney, Agent, or Firm* — Young Basile Hanlon & MacFarlane P.C.

(57) ABSTRACT

Portable noise generator apparatuses and methods may be used to mask sounds in a hunting area. A noise generator apparatus may have a portable housing configured to be used by a hunter in a hunting area where game may be present, a loudspeaker positioned in the housing, and an electronic noise generator held within the housing. The electronic noise generator may be used to output noise through the loudspeaker to mask sounds made by the hunter while in the hunting area, and the noise may comprise frequencies perceptible by a non-human species. The noise may include white noise and ambient noise that is capable of limiting or covering the sounds of the hunter perceived by game animals.

7 Claims, 8 Drawing Sheets

(56) References Cited

U.S. PATENT DOCUMENTS

| | | | | |
|---|---|---|---|---|
| 8,223,985 | B2 | 7/2012 | Loud | |
| 8,761,411 | B2 * | 6/2014 | Zickmantel | G10K 11/175 381/57 |
| 2004/0223625 | A1 * | 11/2004 | Stilwell | A01M 31/004 381/124 |
| 2011/0158435 | A1 * | 6/2011 | Ono | H03F 1/0261 381/120 |
| 2012/0314890 | A1 * | 12/2012 | El-Hoiydi | H04R 25/558 381/315 |
| 2013/0185061 | A1 * | 7/2013 | Arvanaghi | G10K 11/175 704/201 |
| 2014/0321686 | A1 * | 10/2014 | Wegener | H04R 1/028 381/332 |

FOREIGN PATENT DOCUMENTS

| | | | |
|---|---|---|---|
| EP | 1364363 | B1 | 5/2012 |
| WO | 9946958 | A1 | 9/1999 |

* cited by examiner

HUNTING NOISE MASKING SYSTEMS AND METHODS

RELATED APPLICATIONS

This application claims the benefit of U.S. Provisional Application No. 61/821,343, filed on 9 May 2013, and U.S. Provisional Application No. 61/842,088, filed on 2 Jul. 2013, the disclosures of which are incorporated, in their entireties, by this reference.

TECHNICAL FIELD

The following relates generally to systems and methods for masking ambient sounds and specifically to apparatus and methods for masking sounds of hunters in the field from the hearing of game animals.

BACKGROUND

Hunters go to great lengths to mask, eliminate, or conceal indicators of their presence from game animals while hunting. For example, many devices and methods have been conceived to eliminate or mask the hunter's scent, his or her visual appearance, and the sounds he or she makes in the field. Even subtle sounds made by the hunter's movement or his or her operation of hunting equipment can be detected by game animals in a hunting area. Even if the hunter is nearly motionless and remains in silence waiting for game animals to come into an ambush location, the sounds of his movement in the concealed location in positioning for the shot can be detected by game animals.

Silencers, dampeners, and other equipment are commonly used, but do not eliminate enough of the sound made by a bow or other hunting weapon to prevent game animals from being undesirably alerted or from fleeing a hunting area. Thus, there remains a need for improvements in preventing the sounds made by hunters from being detected by game animals.

SUMMARY

According to at least one embodiment, a portable noise generator apparatus for masking sounds in a hunting area is provided herein. The noise generator apparatus may comprise a portable housing configured to be used by a hunter in a hunting area where game may be present, a loudspeaker positioned in the housing, and an electronic noise generator held within the housing. The electronic noise generator may be configured to output noise through the loudspeaker to mask sounds made by the hunter while in the hunting area, and the noise may comprise frequencies perceptible by a non-human species.

The noise generated may comprise frequencies imperceptible by humans. The electronic noise generator may also be configured to output reproductions of an ambient sound. In some cases, the noise and the reproductions of an ambient sound may be emitted by the loudspeaker simultaneously.

The loudspeaker may comprise a plurality of directional loudspeakers configured to emit sound in a plurality of directions. Another embodiment may comprise an attachment feature, such as an attachment feature is configurable to suspend the portable housing in the air or to attach or adhere the portable housing to a surface.

The electronic noise generator may be configured to selectively output either a first noise or a second noise, the first noise comprising frequencies perceptible by a first non-human species and the second noise comprising frequencies perceptible by a second non-human species. In another embodiment, the portable noise generator may further comprise a sensor configured to control the electronic noise generator in response to a signal emitted from a remote to the sensor.

According to another embodiment, a multidirectional noise generator for masking sounds in a hunting area may comprise a portable housing configured to be used by a hunter in a hunting area where game may be present. The housing may have a chamber and a plurality of sloped surfaces, with the chamber having a central axis and the plurality of sloped surfaces being spaced around the central axis. The generator may also include a loudspeaker positioned in the chamber that is facing the plurality of sloped surfaces and an electronic noise generator held within the housing and configured to output noise through the loudspeaker to mask sounds made by the hunter while in the hunting area. The noise may be multidirectionally deflected by the plurality of sloped surfaces.

The generated noise may be deflected from the plurality of sloped surfaces at an angle between about 80 degrees and about 100 degrees and may come from a loudspeaker that is positioned centered around the central axis. The loudspeaker may face downward and the sloped surfaces may slope away from the central axis below the loudspeaker. A strap may be included that has a first end attached to the housing and a second end removably attachable to the housing.

The noise may comprise frequencies perceptible by a non-human species. The electronic noise generator may be configured to output reproductions of an ambient sound as well.

In another embodiment, a method of masking sounds in a hunting area may be provided, wherein the method may comprise providing an electronic noise generator in a hunting area that is configured to emit noise through a loudspeaker, and emitting noise through the loudspeaker using the electronic noise generator to mask sounds made by a hunter while in the hunting area. This noise may include frequencies perceptible by a non-human species and may mask sounds of the hunter while in the hunting area.

Providing the electronic noise generator in a hunting area may include suspending the loudspeaker above the ground in the hunting area or carrying the loudspeaker while it is emitting noise. Ambient sounds may also be emitted through the loudspeaker using the electronic noise generator.

In one embodiment, the user may selectively control the frequencies of the emitted noise between a first range perceptible by a first non-human species and a second range perceptible by a second non-human species.

The foregoing and other features, utilities and advantages of the invention will be apparent from the following more particular description of a preferred embodiment of the invention as illustrated in the accompanying drawings.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
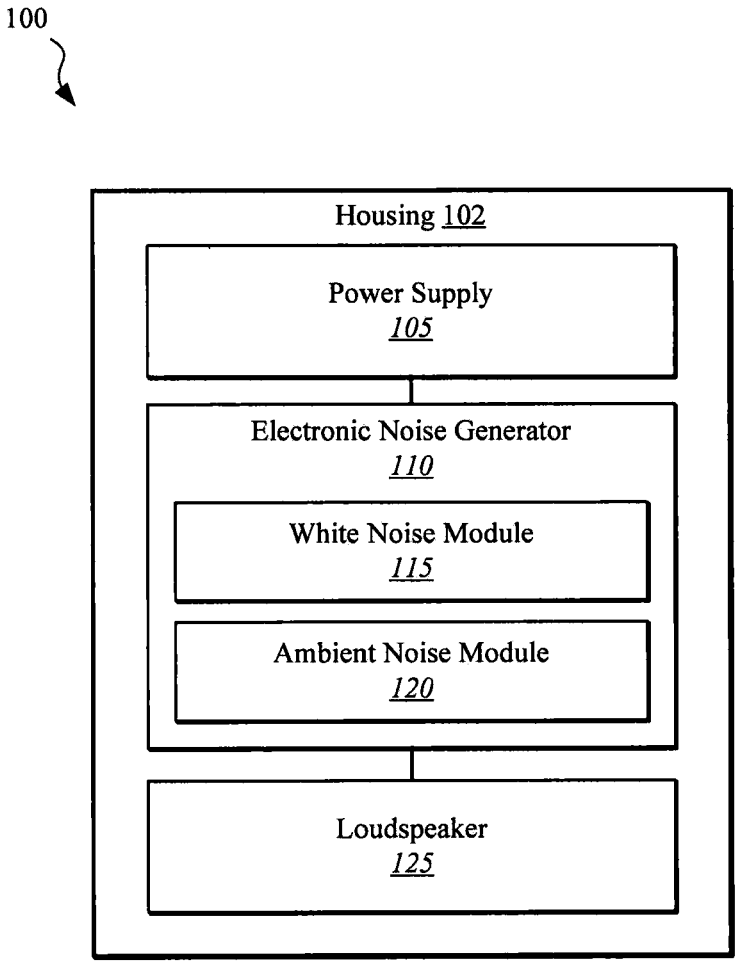
FIG. 1 is a block diagram of a hunting noise masking apparatus of the present disclosure.
Figure 2A:
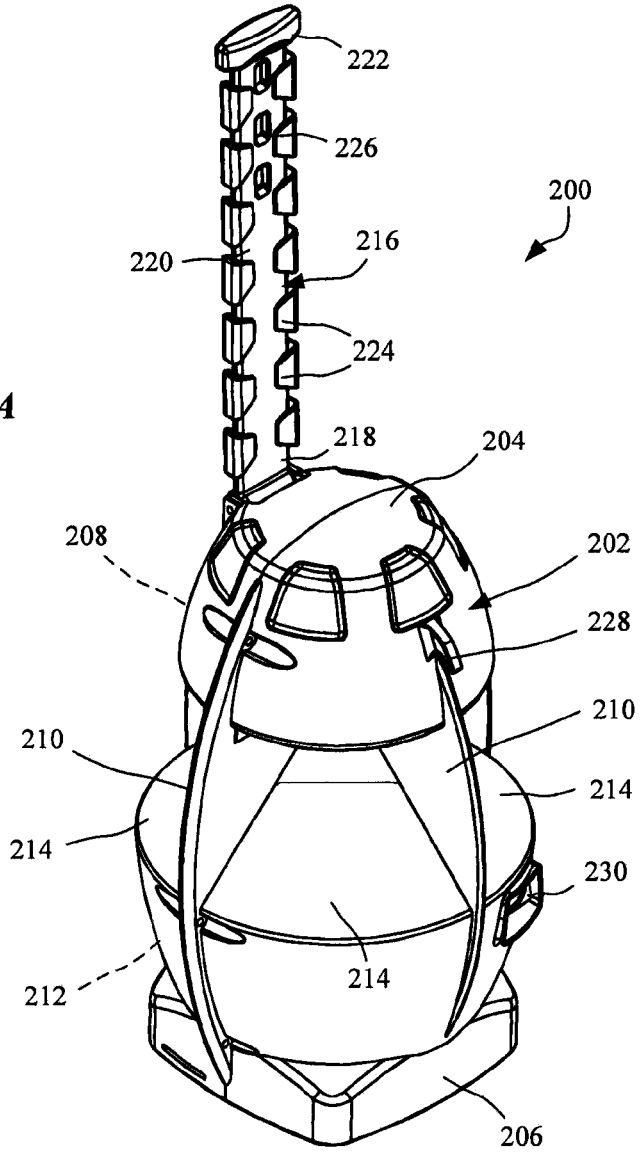
FIG. 2A is a perspective view of an embodiment of a hunting noise masking apparatus of the present disclosure.
Figure 2B:
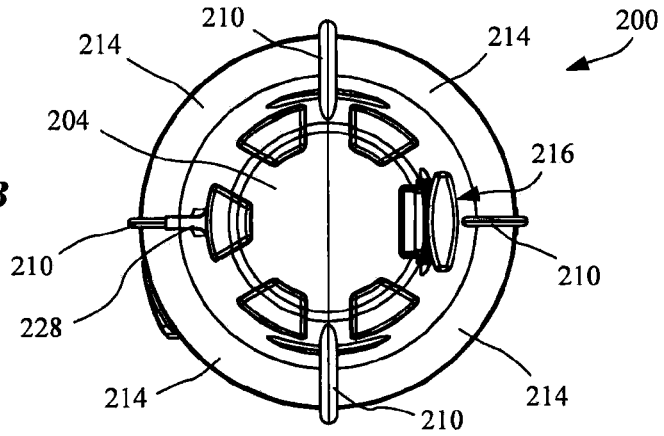
FIG. 2B is a top profile view of the apparatus of FIG. 2A.
Figure 2E:
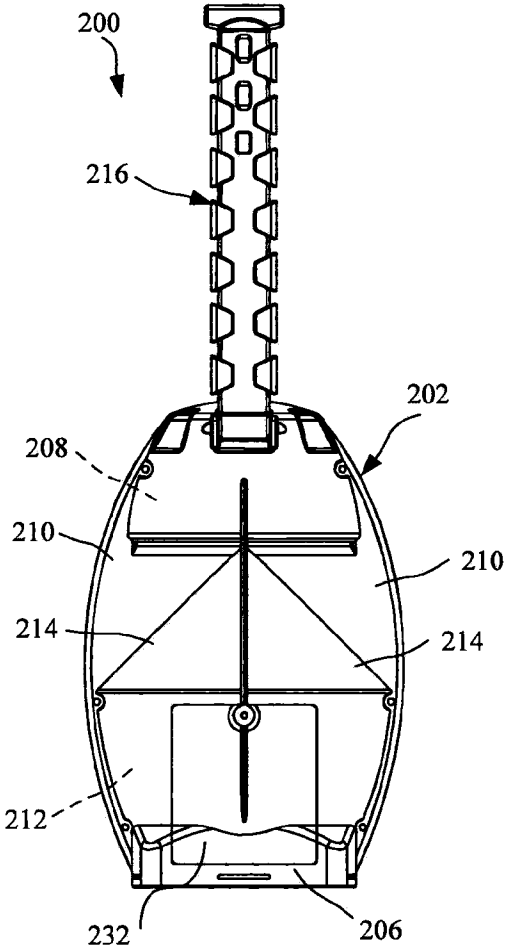
FIG. 2E is a back profile view of the apparatus of FIG. 2A.
Figure 2D:
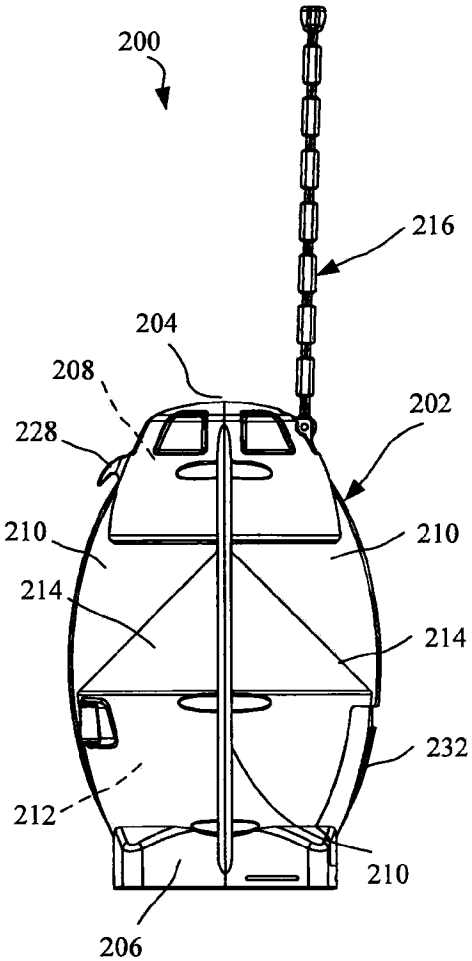
FIG. 2D is a side profile view of the apparatus of FIG. 2A.
Figure 2C:
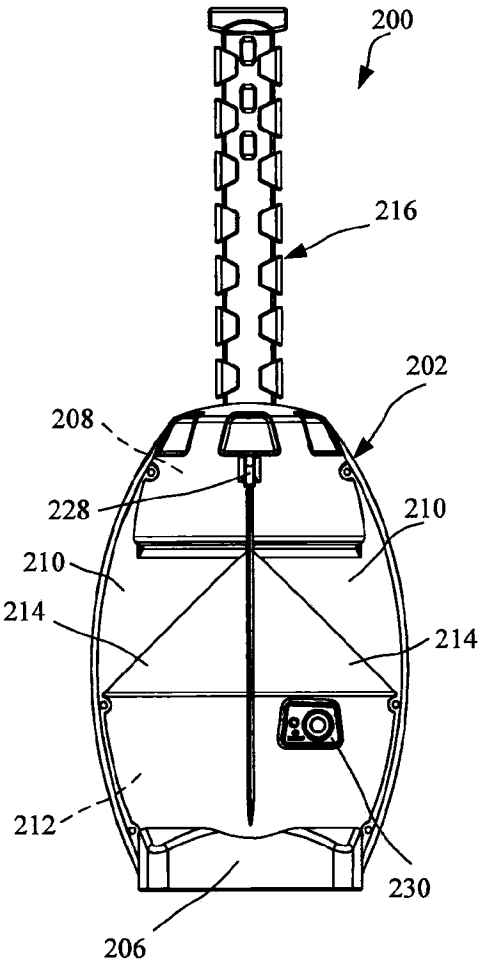
FIG. 2C is a front profile view of the apparatus of FIG. 2A.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Embodiments of the present disclosure may beneficially reduce the chance that game animals will detect the presence of a hunter, photographer, or wildlife enthusiast (collectively referred to as "hunter" hereinafter for simplicity) while in the field where game animals may be present by masking sounds made by the hunter while hunting in a hunting area in the field. For simplicity, reference to the "hunting area" means any location where a hunter, photographer, or wildlife enthusiast may be pursuing or attempting to close the distance with respect to any type of game or wild animal.

The noise generated by the apparatus may include white noise, animal sounds, and/or ambient noise naturally found in the hunting area that is emitted by a loudspeaker over an extended time period. Thus, when the hunter quietly moves through the hunting area, the noise generated by the apparatus obscures the noise generated by the hunter's movement. This allows him or her to counter the advantage gained by game animals' sensitive hearing, allowing him or her to move into position and/or strike with significantly less chance of being detected by prey. The noise generator's portability may allow the hunter to position the generator in the hunting field or wear the noise generator while moving.

As used herein, "white noise" may refer to an audible signal that has a flat frequency spectrum over a range of frequencies. The white noise may have a broad range of frequencies with equal magnitude. "White noise" may also encompass signals having frequency spectra patterns that are not flat, such as pink noise, brown noise, blue noise, violet noise, and grey noise.

In some embodiments, the systems and methods disclosed herein produce noise targeted to frequencies perceptible by non-human species, such as game animals. In this fashion, the noise produced by the systems and methods can impair the hearing of certain species of animals that is outside normal human hearing. In some cases, human-audible frequencies can be generated more quietly than non-human-audible frequencies so that the hunter's hearing is not as significantly impaired by the device as other animals. In some embodiments, sounds generated may include frequencies perceptible by a non-human species. Thus, humans may not be able to perceive those frequencies. Simultaneously, other frequencies may be emitted that are audible to humans.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Referring now to the figures in detail, FIG. 1 shows a block diagram of an exemplary embodiment of a device for masking noise in a hunting area. The device 100 may comprise a housing 102 containing a power supply 105, an electronic noise generator 110, and a loudspeaker 125. The electronic noise generator 110 may comprise a white noise module 115 and an ambient noise module 120.

The housing 102 may be a portable housing configured to be portable by a hunter into a hunting area. For example, the housing 102 may be configured to be carried by the hunter or wearable by the hunter on a pack. See, e.g., FIG. 7. The housing 102 may comprise openings or ports for the emission of noise from the loudspeaker 125 or for a sensor to receive signals from a remote control. The housing 102 may preferably be rugged and water-resistant, thereby being suited for outdoor use in adverse weather and other climate conditions. Thus, the housing 102 may comprise plastics or metals that are water resistant and light and durable enough to be carried long distances by a hunter. In some arrangements, the housing 102 may be camouflaged to visually mask its presence in the hunting area. The exterior of the housing may comprise attachment points for leaves or other brush material to camouflage the presence of the device while being used in the field. The housing 102 may be configured to be positioned in the hunting area on or above the ground. For example, the housing 102 may comprise a strap or other component allowing the device 100 to be hung or suspended in the air by a stand, truss, branch, log, or tree limb. See FIG. 7. The housing 102 may also comprise a base portion allowing the hunter to steady the device 100 on a flat surface or on a rock. In an example embodiment, the housing may be about 10-12 inches tall and about 5-6 inches wide and deep.

The power supply 105 may provide power to the electronic noise generator 110. In some cases, the power supply 105 may also provide power to the loudspeaker 125. The power supply 105 may beneficially be a portable power source, such as an energy storage device with a power converter. For example, the power supply 105 may comprise batteries, a fuel-based energy generator, a solar or wind power generation device, or another comparable power source that can be moved into a hunting area and provide power for a sustained period of time.

The electronic noise generator 110 may comprise an electronic device configured to output noise through the loudspeaker 125. In some embodiments, the electronic noise generator 110 may thus comprise a computing device configured to reproduce a noise through the connection to the loudspeaker 125, such as a prerecorded noise stored by an electronic storage device. In one embodiment, the electronic noise generator 110 may be an electronic audio player, such as a digital audio device (e.g., MP3 or WAV player), and the electronic audio player may comprise a memory (e.g., solid state flash memory, optical disk, RAM, ROM, hard drive, or other comparable electronic storage medium). The memory may comprise audio data that, when produced by the loudspeaker 125, comprises white noise, animal sounds, and/or ambient noise where the housing 102 is positioned. In some embodiments, the electronic noise generator 110 generates the white noise, animal sounds, or ambient noise itself without reproducing a recording or other prerecorded data stored by memory. This may be done by a noise generating circuit or apparatus that is part of the electronic noise generator 110.

The white noise module 115 may comprise data stored on an electronic storage medium connected to the electronic noise generator 110. The white noise module 115 may comprise the data used to generate white noise, such as computer program instructions for the electronic noise generator 110 or a recording of at least one type of white noise. In some embodiments, the white noise module 115 may be accessed by a computing device or other control module of the electronic noise generator 110, wherein the white noise module 115 may be accessed to produce a plurality of different kinds of white noise. For example, the white noise module 115 may comprise or be able to produce white noise along a plurality of different frequency ranges, loudnesses, frequency spectra profiles, or other characteristics.

In these embodiments, the white noise module 115 may therefore be accessed by the electronic noise generator 110 to produce a desired type of white noise for the hunting area and game animals being sought by the hunter. In this manner, the hunter having the device 100 can mask his or her movements while hunting in the field using white noise specially formulated or targeted toward the game animals he or she is hunting (e.g., in different or overlapping frequency ranges for different kinds of small game, big game, water fowl, predators, etc.). In some embodiments, the electronic noise generator 110 may not comprise a white noise module 115. In these cases, the electronic noise generator 110 may only produce ambient noise using the ambient noise module 120.

The ambient noise module 120 may comprise data stored on an electronic storage medium connected to the electronic noise generator 110. The ambient noise module 120 may comprise the data used to generate ambient noise, such as computer program instructions for the electronic noise generator 110 or a recording of at least one type of ambient noise. These ambient noises may comprise animal sounds (e.g., chirping birds, deer or duck calls/cries, frog noises, blackbird noises, etc.). In some embodiments, the ambient noise module 120 may be accessed by a computing device or other control module of the electronic noise generator 110, wherein the ambient noise module 120 may be accessed to produce a plurality of different kinds of ambient noise. For example, the ambient noise module 120 may comprise or be able to produce ambient noise along a plurality of different frequency ranges, loudnesses, patterns, or other characteristics. Some example ambient noises include sounds of wind, rain, streams, leaves, insects, and/or birds. Ambient noises may also include sounds attracting animals, such as the sounds of mating calls or other calls.

In these embodiments, the ambient noise module 120 may therefore be accessed by the electronic noise generator 110 to produce a desired type of ambient noise for the hunting area and game animals being sought by the hunter. In this manner, the hunter having the device 100 can mask his or her movements while hunting in the field using ambient noise specially formulated or targeted toward the game animals he or she is hunting (e.g., in different or overlapping frequency ranges for different kinds of small game, big game, water fowl, predators, etc.). In some embodiments, the electronic noise generator 110 may not comprise an ambient noise module 120. In these cases, the electronic noise generator 110 may only produce white noise using the white noise module 115.

In some embodiments, the sound to be output from the electronic noise generator 110 may be developed according to the following method. Sounds may be recorded in nature by a sound recorder. The recorded sound files may be loaded into a computer and edited using audio recording software. Natural sounds may be combined with white noise. In some cases, depending on the target game animals of the hunter, the computer may be used to digitally shift the frequencies of the combined tracks to be concentrated in and match the sensitive hearing range of the game animals. For example, in hunting deer, a frequency range of about 115 hertz to about 54 kilohertz may be used as the range in which the noise generated is concentrated. Other ranges may be used for elk, bear (e.g., black bear), wild hog, ducks, pheasants, or other game. This frequency-augmented sound may be stored by the electronic noise generator 110 and reproduced using the loudspeaker 125. In some arrangements, the noise created may be used to attract game to the noise generator, such as by making sounds of a call.

Still referring to FIG. 1, the loudspeaker 125 may comprise one or more loudspeakers. Preferably, the loudspeaker 125 may be an omnidirectional speaker, or the loudspeaker 125 may comprise one or a plurality of loudspeakers arranged to emit sound in a plurality of outward directions. The loudspeaker 125 may beneficially be configured to emit high and low frequencies that may be beyond the audible range of frequencies of humans so that white and ambient noise generated can be properly reproduced in the audible range of the game animals or other non-human species being targeted by the hunter.

The loudspeaker 125 may be positioned in the housing 102 in a manner to prevent it from being muffled by the surroundings where the device 100 is deposited and to prevent it from being exposed to adverse weather and other dirty outdoor conditions. Thus, in some embodiments, the loudspeaker 125 may be weatherproofed, waterproofed, or placed behind a protective film or cover to allow it to function in rugged outdoor areas. In some arrangements, the loudspeaker 125 may comprise a plurality of loudspeakers positioned on the exterior of the housing 102 facing different directions away from the housing 102. In these embodiments, the housing 102 may preferably have multiple surfaces facing different directions on which the loudspeakers may be mounted or through which they may protrude.

In some embodiments, the device 100 may comprise additional components, such as structural components of the housing 102, attachment features for linking the device 100 to trees or other ambient vegetation or rocks, remote controls, and other features discussed in more detail in connection with FIGS. 2A-2E and 3 below.

FIGS. 2A-2E and 3 show an embodiment of a hunting noise masking system 200 according to another embodiment of the present disclosure. In this embodiment, the system 200 may comprise a housing 202 having an upper end 204 and a lower end 206. The upper end 204 may comprise an upper chamber 208 and may be structurally linked to the lower end 206 by support and reflection vanes 210. The lower end 206 may comprise a lower chamber 212 defined at least in part by a conical reflection surface 214. The lower chamber 212 may also be defined as being below the conical reflection surface 214 even if the lower chamber 212 is not defined by it.

The upper end 204 may include an attachment feature, such as attachment strap 216. An attachment feature may be used to at least temporarily attach the housing 202 to vegetation, a stand, a blind, or other environmental elements in the hunting area. Thus, attachment strap 216 may be a flexible strap pivotally linked to the upper end 204 at a proximal end 218 of the strap 216. The strap 216 may comprise a strap body 220 extending to a distal end 222. Along the strap body 220, protrusions 224 may be formed to improve the grip of the strap body 220 when it is wrapped around a tree limb or other environmental element. Apertures 226 may be formed near the distal end 222 of the strap 216 that permit the strap 216 to be hooked to a branch, stand, or to another portion of the housing 202 or strap 216, such as the strap hook 228 protruding from the upper end 204 of the housing 202. In some embodiments, additional or other strap hooks may be positioned around the exterior of the housing 202, such as a hook on the housing near the proximal end 218 of the strap 216. The strap 216 may also comprise a hook along its length to allow the strap 216 to wrap around and attach to itself. The strap 216 in FIG. 2 is shown extending vertically from the housing 202. In other embodiments, the strap 216 may extend horizontally and hook to the housing after forming a horizontal loop (e.g., to wrap around a tree trunk). In yet other embodiments, more than one attachment strap 216 may be attached to the housing 202. The attachment feature may attach or adhere the housing 202 to a surface, such as to the side of a rock or tree trunk. For example, the attachment feature may comprise a screw, adhesive surface, or any other suitable securement device configured to be attached to any variety of surfaces and structures.

Other attachment features may be used with the housing 202. In one example embodiment, the housing 202 may include hooks, loops, or openings on its exterior to allow the hunter to use rope or bungee cords to tie or strap the housing 202 without using the strap 216. Thus, in some embodiments, the strap 216 may be omitted.

The lower end 206 may comprise a base portion that allows the housing 202 to be supported by or balanced on a surface (e.g., the ground). The housing 202 may preferably be attached or mounted above the ground, such as being suspended in the air, in order to improve the ability of the device 200 to emit sounds so that they carry over longer distances and over brush or other obstacles.

The upper chamber 208 may contain a loudspeaker directed downward toward the conical reflection surface 214. See FIG. 3. The lower chamber 212 may house an electronic noise generator, battery, controls, and other components. See FIG. 3. In FIGS. 2A-2E, the chambers 208, 212 are indicated using dashed lines to show that they are within the housing 202 at their respectively indicated locations. The interiors of the chambers 208, 212 are directly indicated in FIG. 3.

To facilitate easier access to batteries and other components, the lower chamber 212 may comprise an access door 232. Controls 230 may be externally accessible on the housing 202 to turn the noise generator on and off, control its loudness, control sounds being emitted, and/or check the status of the device 200. The controls 230 may be recessed in the housing 202 to prevent damage. In some embodiments, the controls 230 may be positioned elsewhere on the housing 202. The controls 230 may also comprise an information display, such as a liquid crystal display (LCD) or light emitting diode (LED)-based screen, that may show battery life, frequency settings of the noise generated, remote control status, and/or other relevant information for the hunter. In some embodiments, the unit may hibernate, meaning it may enter a power saving mode to preserve and prolong battery life. A hibernation mode may be entered automatically, such as after a period of inactivity or a period of not receiving a signal from a user's remote, or may be manually controlled by the user, such as by use of the remote.

Figure 3:
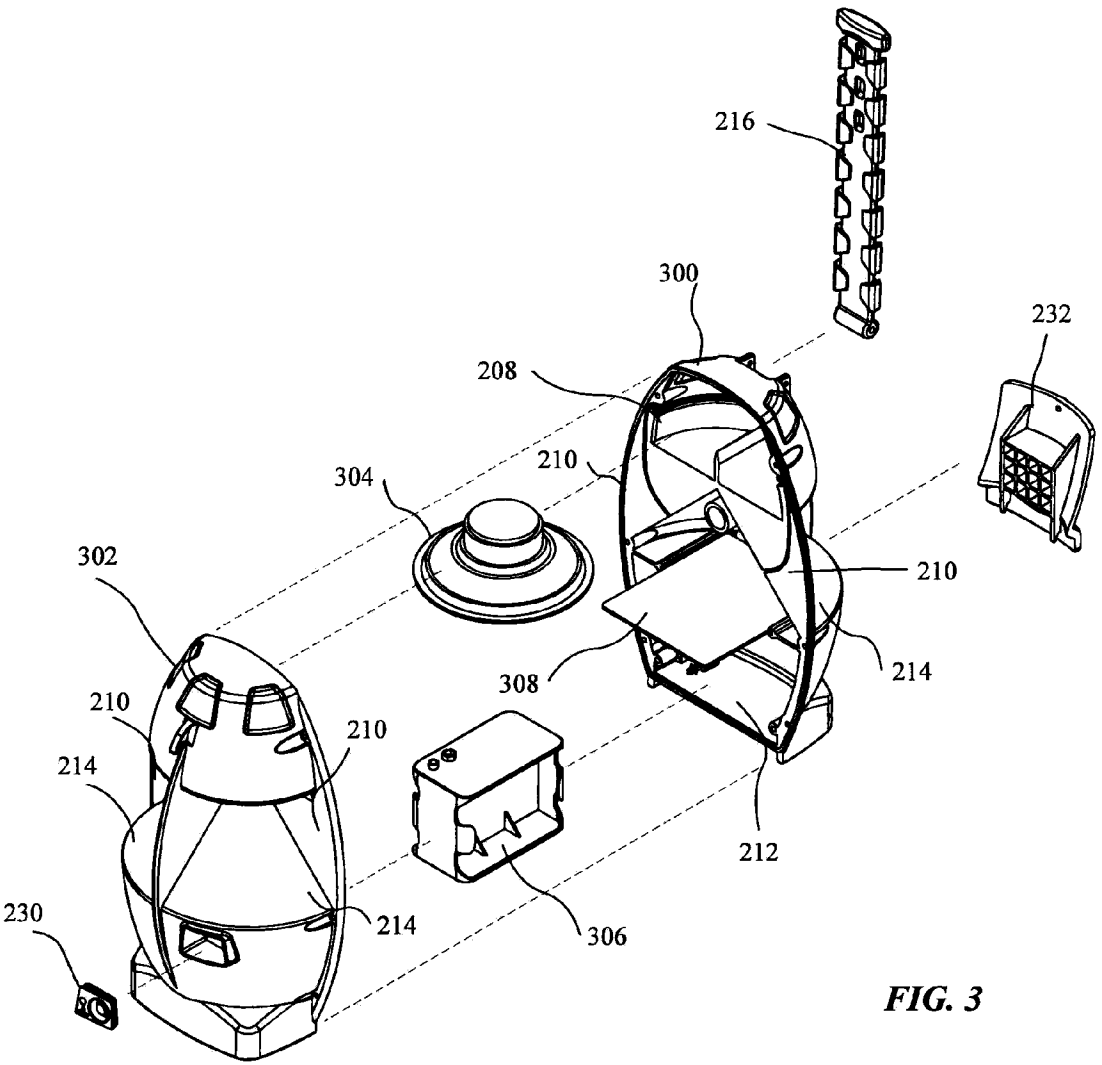
FIG. 3 is an exploded view of the embodiment of FIG. 2A.

As shown in FIG. 3, the housing 202 may comprise at least two sides 300, 302. The loudspeaker 304 may be assembled between and within the two sides 300, 302 in the upper chamber 208 above the conical reflection surface 214. The lower chamber 212 may house an energy storage device such as battery bank 306 and an electronic noise generator such as a circuit 308. The circuit 308 may be controlled by the controls 230 and electrically connected to output noise via the loudspeaker 304. The circuit 308 may comprise an audio recording device or memory device to record and reproduce sounds. The circuit 308 may also comprise an antenna to receive and/or send signals. In some embodiments, the antenna may extend or be attached out of the housing 202.

The compact and portable design of the exemplary embodiment of FIGS. 2A-2E and 3 may be small enough to move to a hunting area and set up by a single hunter. Once in use, the conical reflection surface 214 may omnidirectionally reflect the sounds made by the loudspeaker 304 away from a central longitudinal axis of the apparatus 200. In some cases, the conical reflection surface 214 may be configured to reflect sound at an angle of about 80 degrees to about 100 degrees from the longitudinal axis. Thus, the conical reflection surface 214 may comprise a rigid, smooth material to limit dampening the sounds generated. The conical reflection surface 214 may be angled downward and outward from the central longitudinal axis to prevent water or debris from accumulating on the conical reflection surface 214. The loudspeaker 304 may also be beneficially facing downward to prevent water and debris from collecting on its surface or in the upper chamber 208. The reflection vanes 210 may provide structural stability to the apparatus 200 and provide extra sound-reflecting surfaces for the loudspeaker 304. In some embodiments, the reflection vanes 210 may comprise openings or apertures to allow sound to propagate through the vanes 210 or for the hunter to use as a point to tie down the apparatus 200.

Figure 4:
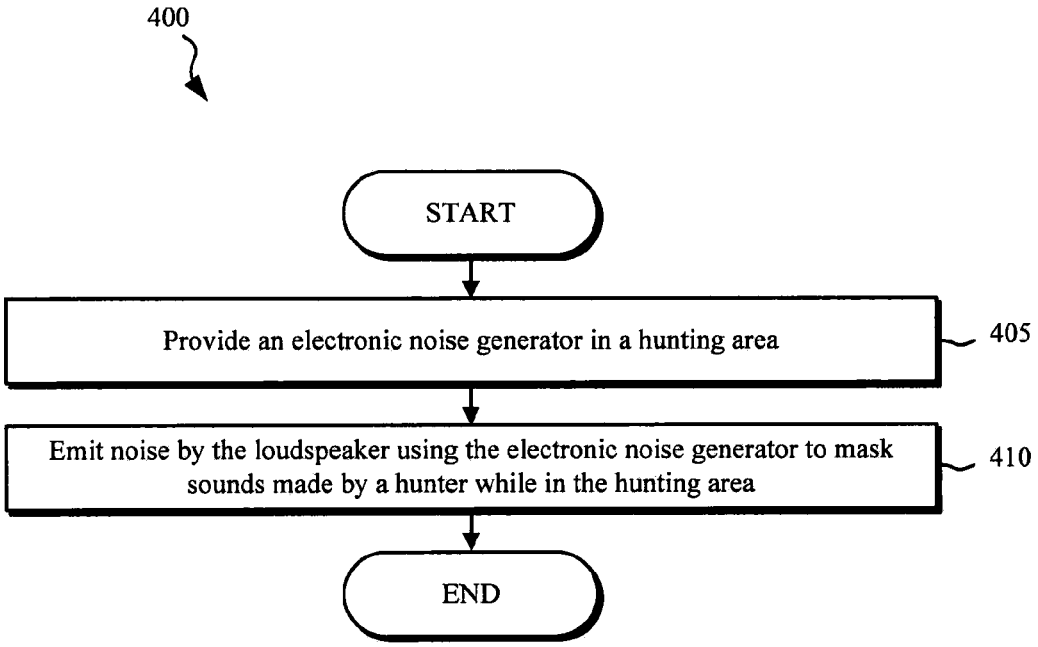
FIG. 4 is a flowchart illustrating a method according to the present disclosure.

FIG. 4 shows a flowchart illustrating a method 400 of using an electronic noise generator to mask sounds in a hunting area. The method 400 begins in block 405 with an electronic noise generator being positioned in a hunting area. The electronic noise generator may be one of the other electronic noise generators disclosed herein, such as electronic noise generator 110 of FIG. 1 or an electronic noise generator described in connection with FIGS. 2A-2E and 3 (e.g., electronic circuit board 308).

Positioning the electronic noise generator may comprise moving the electronic noise generator to the hunting area. A "hunting area" may be a geographical area in which a hunter plans to hunt. The hunting area may be limited geographically and temporally. In some embodiments, a hunting area may include an expected range of areas in which game animals will be hunted by the hunter. The electronic noise generator may thus be portable and capable of being secured in a hunting area, such as by being tied up or suspended in the air in the hunting area. In some embodiments, the electronic noise generator may comprise a security lock or cable to help prevent theft of the electronic noise generator if it is left unattended in the hunting area.

When the electronic noise generator is positioned in the hunting area, the hunter may emit noise by the loudspeaker using the electronic noise generator to mask sounds made by the hunter while he or she moves to the position where the electronic noise generator will be finally positioned. Thus, in some embodiments, the order of blocks 410 and 405 may be reversed. The electronic noise generator may also be provided in a hunting area by the hunter carrying it into the hunting area (i.e., without the noise generator being separated from the hunter after being positioned in the hunting area).

In block 410, a loudspeaker is used to emit noise to mask sounds made by a hunter while in the hunting area. As discussed previously herein, the noise emitted by the loudspeaker may comprise white noise and/or ambient noise, depending on the preferences and needs of the hunter. The noise emitted may be targeted toward impairing the hearing of a specific non-human species of game animal. Masking the sounds made by the hunter may comprise emitting the noise from the loudspeaker at a volume sufficient to drown out normal sounds made by the hunter while moving through the hunt area. In one embodiment, the volume may be about 100 decibels in order to mask sounds of a hunter's footsteps, the sounds of a blind or stand being set up, the sound of the hunter's breathing or sounds made by his or her pack or weapon, and the like. The hunter may deactivate or subdue the volume of the loudspeaker once he or she is in a quiet, prepared position for hunting.

Figure 5:
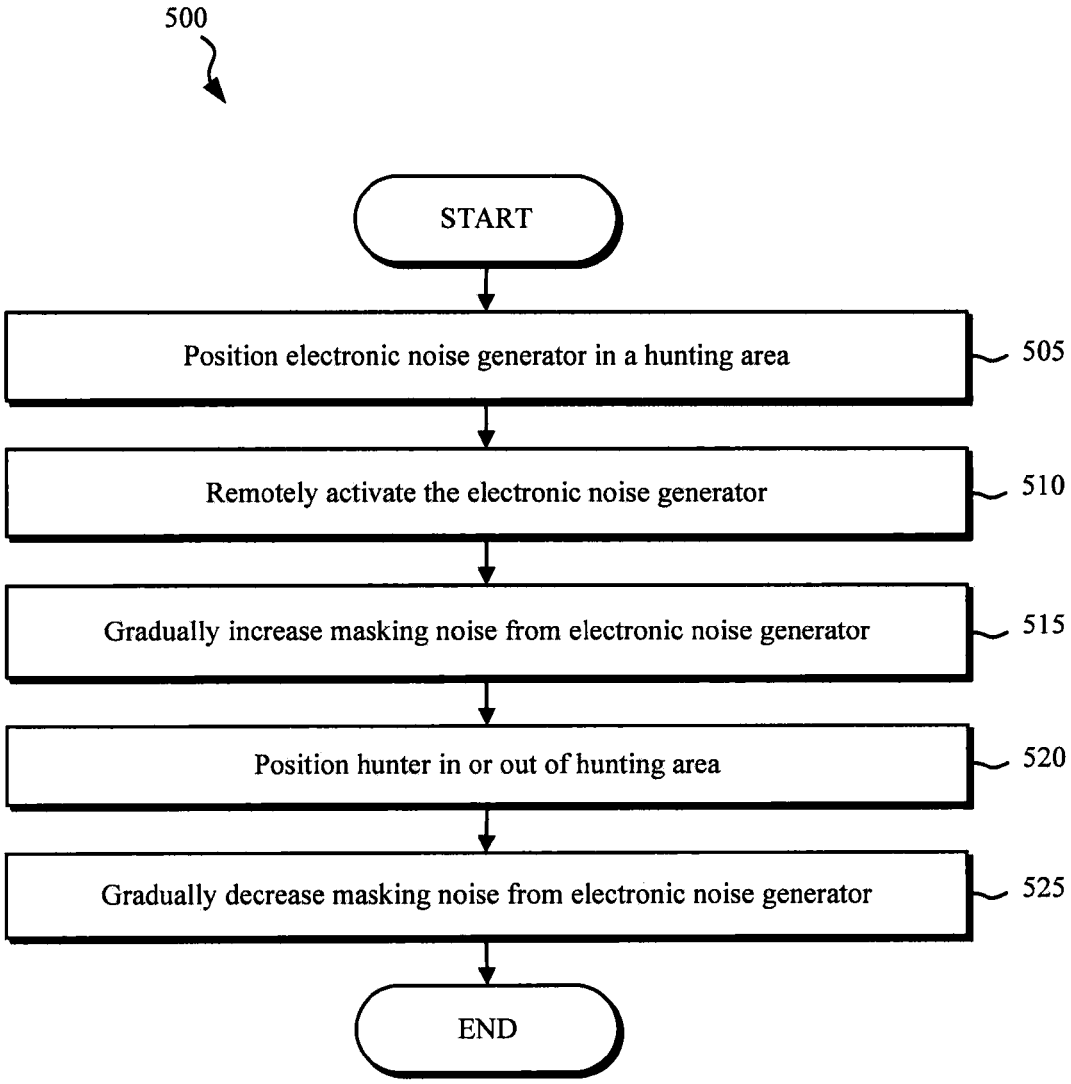
FIG. 5 is a flowchart illustrating another method according to the present disclosure.

FIG. 5 is a flowchart illustrating another method 500 of the present disclosure. In block 505, the electronic noise generator may be positioned in a hunting area. This block may be performed in the manner described above in connection with block 405. Typically, the noise generator may be positioned some time before a hunt when a hunter sets up a blind or stand to be used during the hunt. The noise generator may or may not be used to mask the sound of the individual setting up the noise generator at this stage.

In block 510, the electronic noise generator may be remotely activated. For example, the hunter may carry a remote communication device (e.g., a radio frequency (RF) transponder remote) configured to transmit a signal to the electronic noise generator to activate it and cause it to emit noise. See also remote control 712 in FIG. 7. In preferable embodiments, the remote activation may take place at a large distance from the noise generator, such as at about 150 yards or about one-half mile from the device. This may allow the hunter to approach the area undetected from a long distance. In some embodiments, the noise generator may be controlled by a timer that activates the emission of sound instead of a remote control, allowing the hunter to control the noise of one or more noise generator from any distance (i.e., not just within range of a remote control). A noise generator may also engage in two-way communication with a remote device. For example, the remote may transmit signals to control the noise generator and the noise generator may emit a signal to indicate the status of the noise generator, such as whether it is active or its remaining battery capacity.

In block 515, the electronic noise generator may gradually increase emission of masking noise. Thus, before or as the hunter approaches the noise generator, the sound emitted may gradually reach a final volume or final mode. Gradual changes in the sound may help prevent the activation of the noise generator from spooking wildlife or otherwise tipping them to the hunter's approach. In at least one embodiment, the gradual change may take between about 30 minutes to about one hour to change the emitted noise from silence to full volume. Depending on the game animals being targeted, the change may be less gradual, taking between about 30 seconds to about 30 minutes. A change of less than 30 seconds may also be used. In a beneficial embodiment, the transition may take about 2.5 minutes. Full volume may be about 100 decibels, as mentioned above, or another setting determined by the hunter.

As the sound gradually increases in volume (or after the sound has reached full volume), the hunter may be positioned in the hunting area, as indicated in block 520. This may comprise the hunter moving into the hunting area, such as walking to a blind or stand near the noise generator. In another embodiment, the hunter may remotely activate the noise generator in block 510 to mask his or her movement out of the hunting area. With the hunter in position (or away from the position) in the hunting area, the noise generator may be remotely deactivated to gradually decrease the masking noise coming from the noise generator, as shown in block 525. In some embodiments, the performance of block 525 may be automatic, such as the noise generator turning itself off when battery power runs low, or after reaching a time limit. The gradual decrease of noise may help reduce the chance that wildlife will be alerted to the hunter's presence in the area. The gradual decrease in volume may be performed along the same range of time periods as the increases in volume described in connection with block 515. In some embodiments, the hunter may hunt while the noise is being generated, and the noise may turn off after he or she leaves the area or carries away the noise generator.

In some embodiments, the gradual increases or decreases in masking noise may comprise changes in the masking noise, such as gradually introducing white noise to a generated ambient noise or vice versa. Thus, the introduction of white noise and ambient noise may be staggered to further prevent disruption of wildlife in the hunting area. In some cases, sounds may increase or decrease in the frequency of their occurrence, whether or not their volume is increased or decreased. For example, a cricket chirp may be emitted only periodically for a first hour, but played with increased frequency over a second hour, even if its volume does not change across each time period.

An activation of the noise generator and/or change in noise volume may also coincide with a change in power consumption of the device. For example, in one embodiment, the device may be in a low-power or "hibernation" state when not emitting sound. In this state, the device may conserve energy on battery power or only use energy from a solar panel, but may still be sensitive to signals received from a remote control carried by the hunter. Upon activation, additional power may be used to emit noise and mask the hunter's movements. Thus, the energy storage of the device may be preserved and extended.

Figure 6:
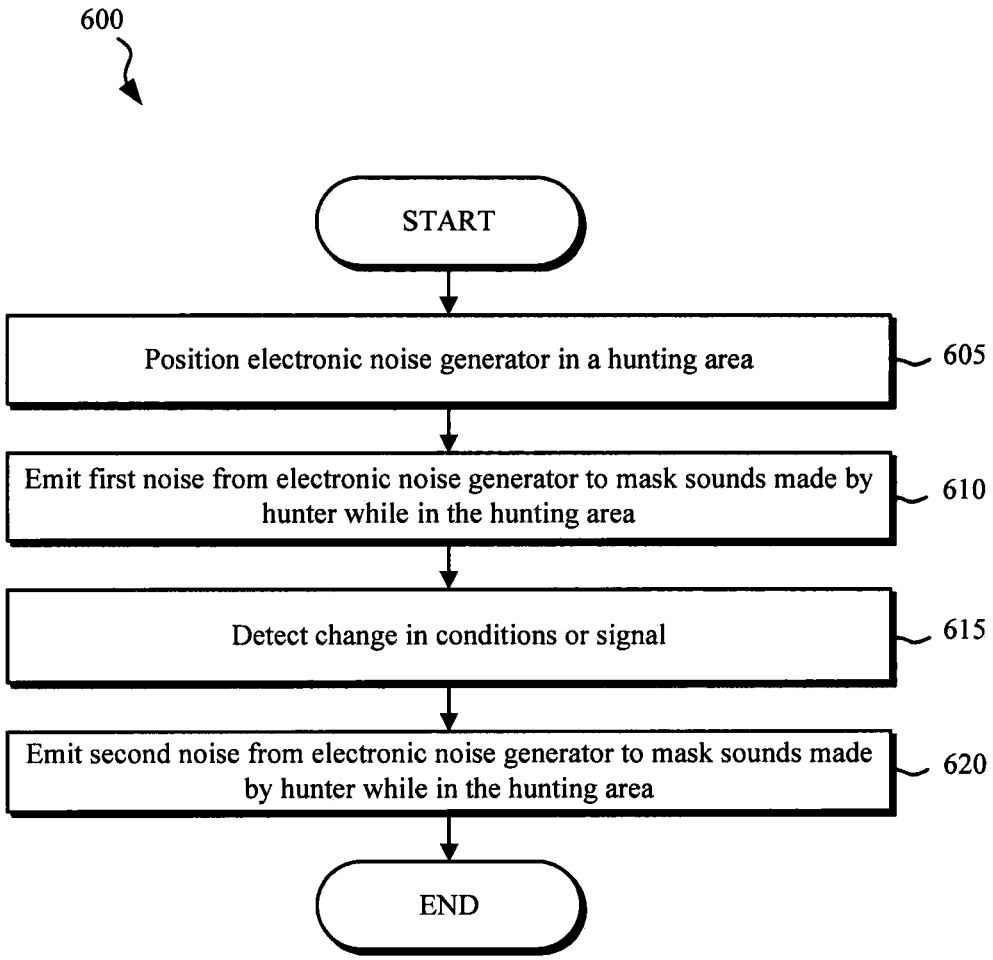
FIG. 6 is a flowchart illustrating another method according to the present disclosure.

FIG. 6 shows a flowchart of another method 600 of using a noise generator to mask sounds made by a hunter in a hunting area. In block 605, an electronic noise generator may be positioned in a hunting area. This may be performed similar to the ways provided in blocks 405 and 505 above. In block 610, the noise generator may emit a first noise to mask sounds made by a hunter while hunting. In block 615, the noise generator may detect a change in conditions or detect a signal from a remote transmitter. Afterward, the noise generator may emit a second noise to mask sounds made by the hunter while in the hunting area.

The first and second noises emitted by the noise generator may be different in several different characteristics. For example, in block 615, the noise generator may detect sounds made by the hunter and automatically change from a lower-volume first noise to a higher-volume second noise. If the hunter gets quieter, the generator may also decrease volume between the first and second noises. In another example, the noise generator may detect a change in lighting (e.g., sunset) and change the noise emitted from a first noise including daytime sounds (e.g., birds) to a second noise of night sounds (e.g., crickets). In another embodiment, the hunter may send a signal in block 615 to cause the noise generator to change from a certain band of frequencies or a certain first recording to a second band of frequencies or recordings. Thus, the first and second noises may correspond with sounds audible by, or attractive to, first and second species of game animals. The first and second noises may also correspond to different conditions determined by the hunter, such as a first noise for hunting and a second noise for when the hunter detects another hunter in the area. A hunter may remotely control the sounds using the signal transmitter used to turn the noise generator on and off. In yet another example, the noise generator may detect loud ambient sounds (e.g., loud winds or roaring river water). Since the noise emitted may not be loud enough to be heard over the detected sounds, the device may then either turn itself off to conserve battery life or increase the volume of the emitted sounds to be audible over the ambient sounds.

Using the embodiments disclosed herein, hunters may reduce the likelihood of being detected by game animals, leading to better and more efficient hunting. Implementation of the systems, apparatuses, and methods disclosed herein may improve the hunter's ability to set up a hunting area, strike targeted wildlife while they are at least partially disabled, and remove hunting equipment and other items from the field without significantly audibly disturbing game in the area.

Figure 7:
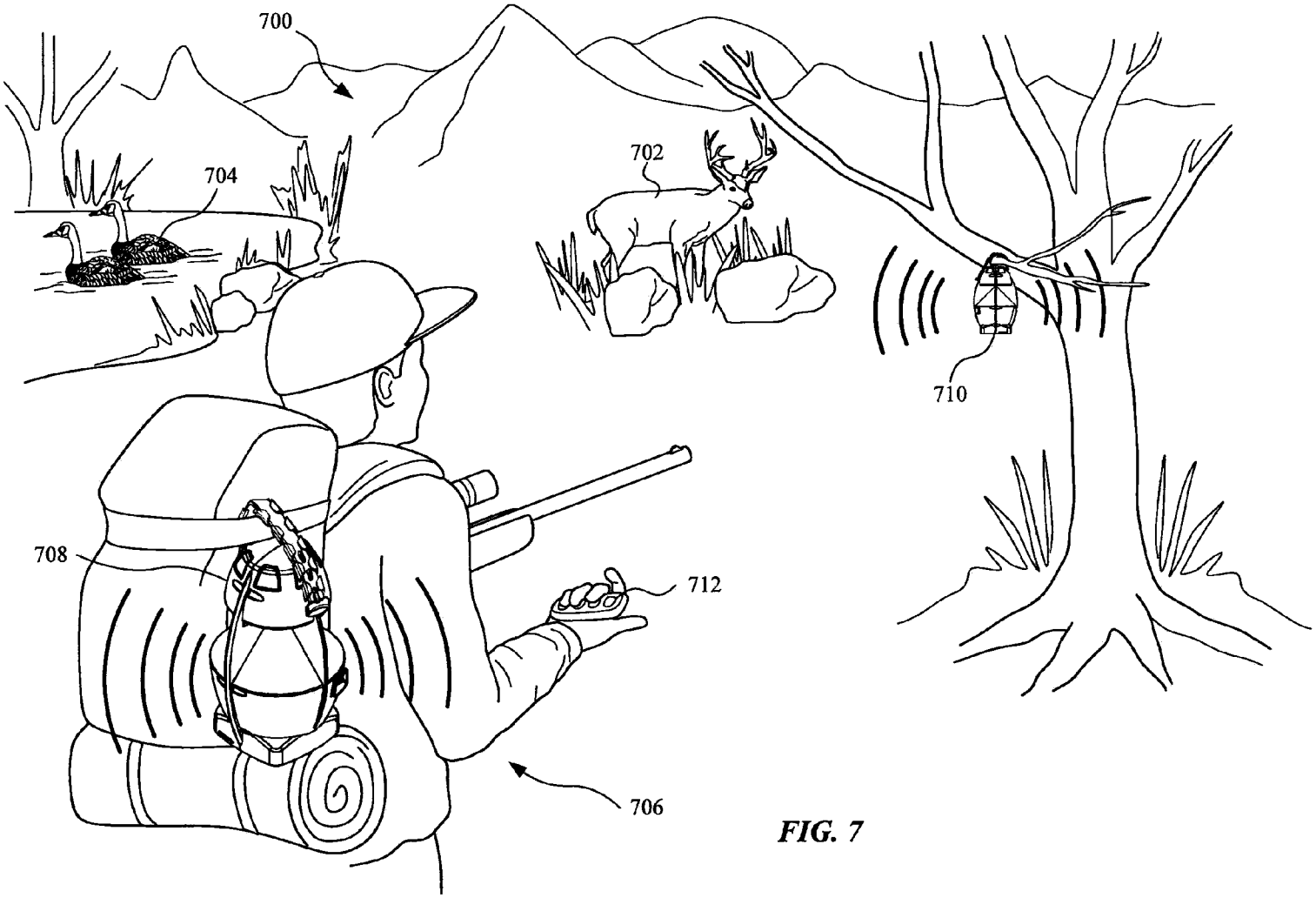
FIG. 7 is an illustration of embodiments of a hunting noise masking apparatus of the present disclosure being used in a hunting area.

FIG. 7 illustrates an implementation of embodiments of the present disclosure in a hunting area 700. Different types of game may be found in the hunting area 700, such as deer 702, waterfowl 704, and other animals. A hunter 706 may position one or more hunting noise generators 708, 710 in the hunting area 700 to mask his or her movements and other sounds from the hearing of the game animals. Although game animals 702, 704 are shown in the presence of the hunter 706 in this illustration, the hunting noise generators 708, 710 may be positioned in the hunting area whether in or out of the presence of the game animals 702, 704. For example, the hunter 706 may deposit a noise generator 710 before starting his hunt. Further, although the hunter 706 is shown using a rifle, the hunting noise generators 708, 710 may be used in all types of hunting and other activities benefiting from a generated hunting noise, such as nature photography and videography.

The hunting noise generators 708, 710 may be manually controlled, automated, or remote controlled, such as by a remote control 712 carried by the hunter 706. A hunting noise generator 708 may also or alternatively be carried by or attached to the hunter 706. In this example scenario, the hunter 706 may use hunting noise generator 708 and/or 710 to mask sounds in frequencies audible by one or more different species of game animals 702, 704. The noise output may be within the frequencies audible by a first type of game (e.g., deer 702), a second type of game (e.g., waterfowl 704), or both. The sound may also be configured to fall within frequency ranges audible by a plurality of other animals. In some embodiments, the hunter 706 may control which type or frequency of noise is generated by a hunting noise generator 708, 710, such as by using the remote control 712.

The previous description of the disclosure is provided to enable a person skilled in the art to make or use the disclosure. Various modifications to the disclosure will be readily apparent to those skilled in the art, and the generic principles defined herein may be applied to other variations without departing from the spirit or scope of the disclosure. For example, although the present disclosure has mainly been directed toward application of the systems and methods disclosed herein in the field of hunting, other similar fields of application will be apparent to those of skill in the art having the benefit of the present disclosure, such as concealment of movements of zookeepers or nature photographers from animals.

Throughout this disclosure the term "example" or "exemplary" indicates an example or instance and does not imply or require any preference for the noted example. Thus, the disclosure is not to be limited to the examples and designs described herein but is to be accorded the widest scope consistent with the principles and novel features disclosed herein.

What is claimed is:

1. A multidirectional noise generator for masking sounds in a hunting area, comprising:

a portable housing configured to be used by a hunter in a hunting area where game may be present, the housing comprising a chamber and a plurality of sloped surfaces, the chamber having a central axis, the plurality of sloped surfaces being spaced around the central axis, the chamber structurally linked to the lower end of the portable housing by a plurality of support vanes that extend outward from the central axis;

a loudspeaker positioned in the chamber, the loudspeaker facing the plurality of sloped surfaces; and an electronic noise generator held within the housing and configured to output noise through the loudspeaker to mask sounds made by the hunter while in the hunting area, wherein the noise is multidirectionally deflected by the plurality of sloped surfaces.

2. The multidirectional noise generator of claim 1, wherein the noise is deflected from the plurality of sloped surfaces at an angle between about 80 degrees and about 100 degrees.

3. The multidirectional noise generator of claim 1, wherein the loudspeaker is positioned centered around the central axis.

4. The multidirectional noise generator of claim 1, wherein the noise comprises frequencies perceptible by a non-human species.

5. The multidirectional noise generator of claim 1, wherein the electronic noise generator is configured to output reproductions of an ambient sound.

6. The multidirectional noise generator of claim 1, further comprising a strap having a first end attached to the housing and a second end removably attachable to the housing.

7. The multidirectional noise generator of claim 1, wherein the loudspeaker faces downward and the sloped surfaces slope away from the central axis below the loudspeaker.

* * * * *